United States Patent [19]

Stenzel et al.

Best Available Copy

[11] 4,216,405

[45] Aug. 5, 1980

[54] LARGE, INDIRECTLY HEATED, OXIDE-COATED CATHODE FOR PRODUCING UNIFORM PLASMAS

[75] Inventors: Reiner L. Stenzel, Pacific Palisades; William F. Daley, Los Angeles, both of Calif.

[73] Assignee: TRW Inc., Redondo Beach, Calif.

[21] Appl. No.: 827,657

[22] Filed: Aug. 25, 1977

[51] Int. Cl.[2] ..... H01J 1/02

[52] U.S. Cl. ..... 313/310; 313/30; 313/32; 313/37; 313/38; 313/337; 313/446

[58] Field of Search ..... 313/37, 38, 30, 32, 313/337, 310, 231.3, 231.4, 446, 447

[56] References Cited

U.S. PATENT DOCUMENTS

| | | | |
|---|---|---|---|
| 2,599,263 | 6/1952 | Law et al. | 313/337 X |
| 3,070,724 | 12/1962 | Herbert et al. | 313/337 X |
| 3,906,276 | 9/1975 | Barraco et al. | 313/337 |

*Primary Examiner*—Saxfield Chatmon, Jr.
*Attorney, Agent, or Firm*—John J. Conners; Benjamin DeWitt

[57] ABSTRACT

A large cathode structure having a diameter on the order of 50 cm for producing uniform plasmas in a magnetic field. The cathode is oxide-coated and indirectly heated by a plurality of heater wires disposed in insulating tubes arranged parallel to each other. The cathode is pressed against the insulating tubes thereby to maintain it substantially flat in spite of expansion and contraction due to the heating and cooling effects. Optionally, the insulating tubes carrying the heater wires may be backed up by a second set of insulating tubes disposed at right angles to the first set. An annular ring is disposed about the cathode and is provided with tungsten springs for forcing the cathode against the heater tubes. This ring may additionally serve as a heat shield and maintain the temperature more uniform about the periphery of the cathode. For large cathodes, the structure may be water cooled by the provision of two copper tubes through which the water flows. Each copper tube may be connected to one terminal of the current source for the heater wires, in such a manner that the currents through adjacent heater wires flow in opposite directions, thereby to minimize the creation of a magnetic field.

12 Claims, 5 Drawing Figures

LARGE, INDIRECTLY HEATED, OXIDE-COATED CATHODE FOR PRODUCING UNIFORM PLASMAS

BACKGROUND OF THE INVENTION

In order to study space plasma physics problems, it is convenient and often times necessary to carry out experiments in the laboratory. In that case, the plasma frequently must be of large dimensions and of uniform density. In addition, it is usually necessary to provide a magnetic field extending through the plasma. Furthermore, the plasma should be collisionless, free of instabilities, adjustable and reproducible over wide parameter ranges.

For these purposes, direct current discharge plasmas are well suited. Such plasmas utilize hot cathodes and grided anodes. Cathodes best suited for this purpose are those which are indirectly heated and oxide-coated. Such cathodes provide large emission currents on the order of 1 ampere per square centimeter ($cm^2$), at relatively low temperatures such as about 800° centigrade (°C.).

Cathodes of this type are commercially available. However, they are generally restricted to diameters less than 10 cm. The construction of large cathodes having diameters of 50 cm or more encounters difficulties which are more severe than those encountered in the construction of smaller cathodes. For example, the thermal expansion due to temperature gradients or the use of different materials and the coating and activation processes have to be specifically treated in order to obtain a uniformly emissive planar surface having a useful lifetime in a high density plasma.

It is accordingly an object of the present invention to provide a large, oxide-coated, indirectly heated cathode for generating a large and high density plasma.

A further object of the present invention is to provide a large cathode of the type discussed, which may be maintained substantially flat or planar in spite of large variations of temperature.

Another object of the present invention is to provide a cathode of the type discussed where the generation of a magnetic field due to the currents flowing through the heater wires is minimized.

Still a further object of the present invention is to provide a large, flat cathode having a large heating capacity and which may be cooled by the flow of a fluid.

The large cathode structure of the present invention having a diameter of about 50 cm has been in use for some time. Some of the experiments which one of the applicants has performed with this large plasma have been described in a series of papers. See, for example, a paper by R. L. Stenzel entitled "Microwave Resonator Probe for Localized Density Measurements in Weakly Magnitized Plasmas," which appears in "Review of Scientific Instruments," Volume 47, May 1976, pages 603–607; another paper by the same author entitled "Whistler Wave Propagation in a Large Magnetoplasma," which appears in "The Physics of Fluids," Volume 19, June 1976, pages 857–864; and another paper by the same author entitled "Filimentation Instability of a Large Amplitude Whistler Wave," in "The Physics of Fluids," Volume 19, June 1976, pages 865–871. The generation of a large electron beam is described in the paper by R. L. Stenzel entitled "Unstable Whistler Wave Propagation Along the Resonance Cone in a Large Beam-Plasma System," which appeared in "Physical Review Letters", Volume 38, Number 8, Feb. 21, 1977, pages 394–397. While these papers refer to a 50 cm diameter oxide-coated cathode, the construction of this cathode has not been revealed in these papers.

It should be noted that such relatively large plasmas of the type discussed may, for example, be used for measurements in tests of a satellite. They may also be used for generating a large, dense beam by accelerating the resulting plasma. Plasmas of this type may be made with any of the noble gases such as helium, argon, krypton, xenon, neon, etc., or even with alkali and other metals such as uranium. Additionally, the cathode structure itself may be utilized for the production of large diameter electron beams.

SUMMARY OF THE INVENTION

In accordance with the present invention, there is provided a cathode structure. The cathode is an indirectly heated cathode having one oxide-coated surface and may have a diameter at least as large as 50 cm. The cathode is flat. A plurality of heater wires are provided which are disposed in insulating tubes. The insulating tubes are arranged parallel to each other and in contact with the back surface of the cathode. These tubes, for example, may be ceramic tubes and serve the additional purpose of supporting the cathode. An additional set of insulating tubes may be provided which are disposed at right angles to the first set to serve as an additional support for the cathode. An annular ring is provided surrounding the periphery of the cathode and spaced from the cathode. Spring means such as tungsten springs are provided between the ring and the cathode for pressing the cathode against the heater tubes while permitting the cathode to expand and contract due to thermal gradients.

The cathode may be provided with a cooling system consisting of two metallic tubes such as copper tubes through which water flows. The two tubes may each be connected to one terminal of a current source for causing an electric current to flow through the heater wires. The heater wires are preferably so connected that the current through alternate insulating tubes flows in opposite directions, thereby to minimize a magnetic field which might be generated by the flow of electric current.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
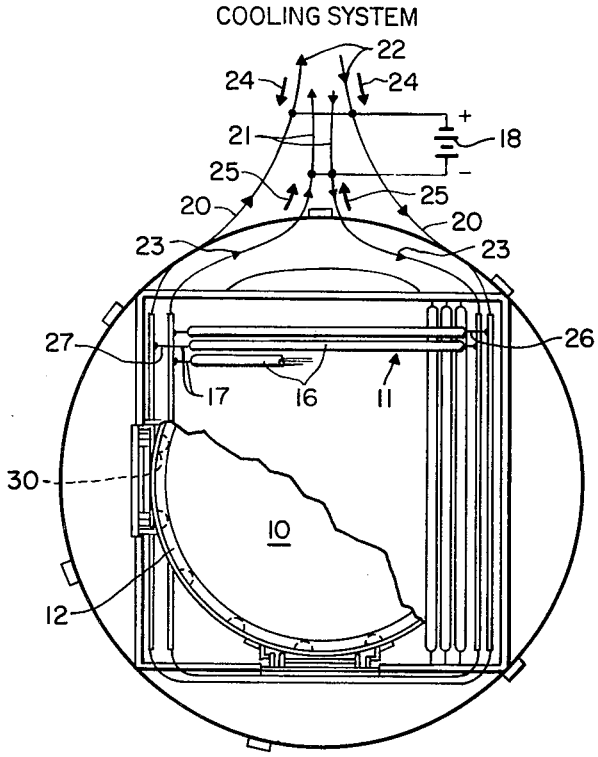
FIG. 1 is a front elevational view of a cathode structure in accordance with the present invention, parts being broken away.

Referring now to the drawings and particularly to FIGS. 1 through 4, there is illustrated one embodiment of the present invention which is particularly adapted for a large size cathode. This cathode has been built with a diameter of 50 cm (about 20 inches).

Specifically, the cathode structure of FIGS. 1 through 4 consists basically of a flat, oxide-coated cathode 10, an insulated heater 11, a plurality of heat shields such as 12 and 14, and a grided anode 15. The construction is such that the anode 15 and the cathode 10 may be separately removed and replaced at will. It will be understood that the grided anode 15 may be omitted, for example, when it is desired to produce only a large electron beam provided there is a background plasma.

The cathode 10 is oxide-coated on one side in a manner which will be subsequently explained. It is supported by a plurality of insulating tubes 16 which are disposed parallel to each other in back of the cathode 10, that is, in contact with the uncoated surface of the cathode. One or more heater wires 17 passes through each of the insulating tubes 16 for indirectly heating the cathode. These heater wires 17 are preferably straight wires to reduce their electrical resistance as compared to a coiled wire. On the other hand, a plurality of wires are preferably used such as six to increase their current carrying capacity.

The heater wires 17 are connected to a voltage source shown schematically at FIG. 1, 18. They are connected to the battery 18 in such a manner that the current flows through the heater wires of adjacent insulating tubes 16 in opposite directions. The reason for this construction is that this will minimize or eliminate the creation of a magnetic field which might cause disturbances of the plasma generated by the cathode structure. This is effected by connecting the heater wires to two sets of hollow copper tubes shown schematically at 20 and 21 in FIG. 1. The water flows through each tube in the direction shown respectively by arrows 22 and 23. That is, the water flows into each tube and out of the same tube. On the other hand, the conductive tube 20 is connected, say, to the positive pole of the battery 18 while the copper tube 21 is connected to the negative pole thereof. Accordingly, the electric current flows in the direction shown by the arrows 24, that is, from the positive pole to the negative pole connected to the tube 21 in the direction shown by arrows 25.

Accordingly, one heater wire, say wire 26, is connected on the right hand side as shown in FIG. 1 to the conductive tube 20 and on the left hand side to the tube 21. The second heater wire 27 has its right hand side connected to the conductive tube 21 and its left hand side to the conductive tube 20, thereby to reverse the direction of the current flow.

Altogether, there may, for example, be 80 of the insulating tubes 16, each of which carries one or more wires which may, for example, consist of tungsten to withstand the generated heat.

Figure 3:
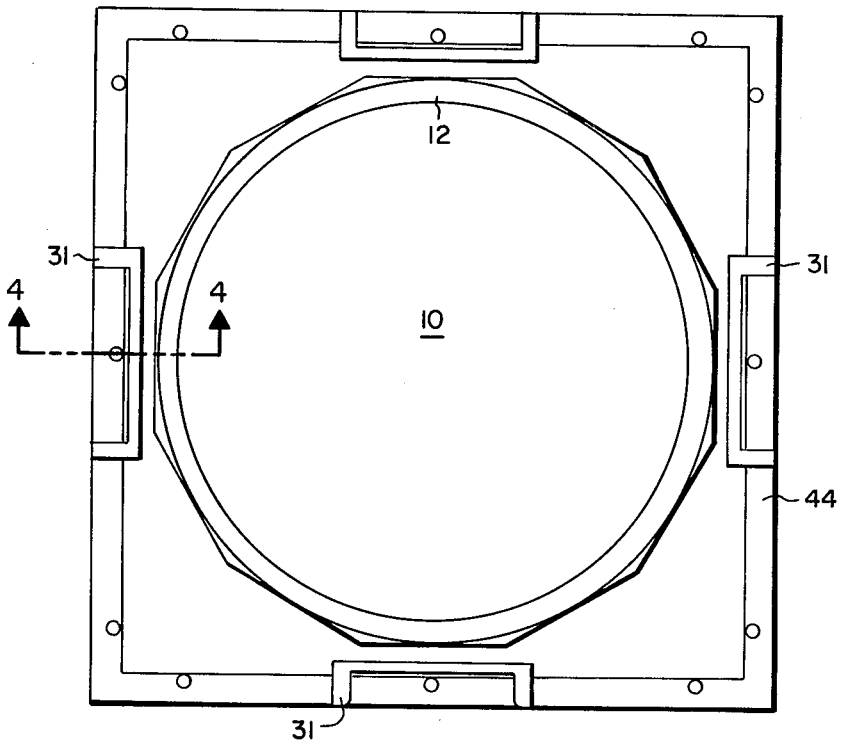
FIG. 3 is a front elevational view on a slightly enlarged scale of the cathode and its support.
Figure 4:
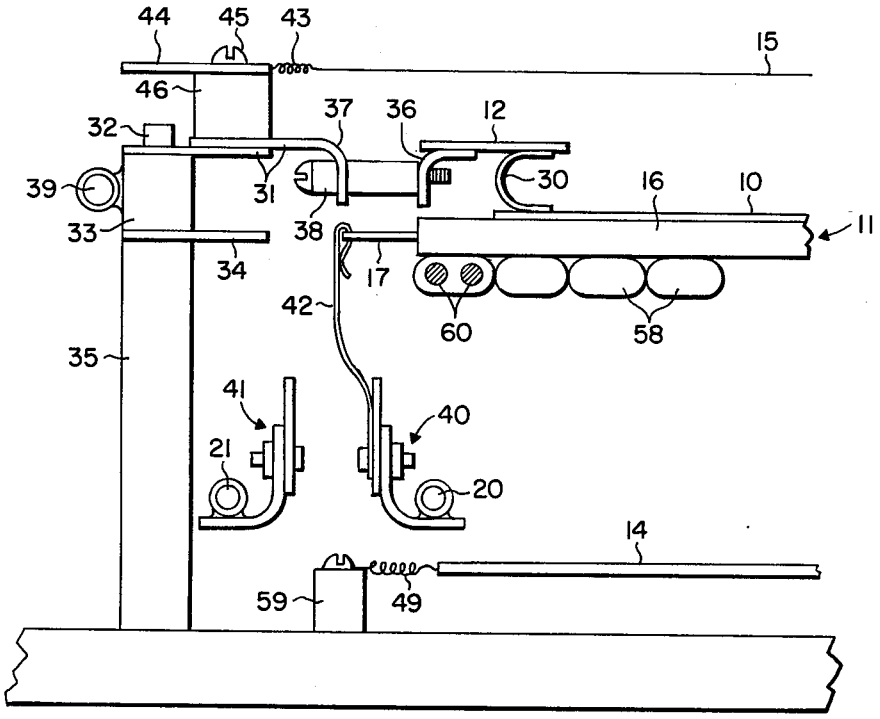
FIG. 4 is a sectional view on enlarged scale and taken on line 4—4 of FIG. 3 and illustrating particularly the heater tubes and their support for maintaining the cathode substantially flat and the electrical connections for the heater wires.

As clearly shown in FIGS. 1 and 3, the cathode 10 is preferably of circular outline. It is pressed against the insulating tubes 16 which may, for example, consist of a suitable ceramic, for example, alumina, to withstand the temperature which may be as high as 1200° C. The periphery or outer rim of the cathode 10 is pressed against the annular heat shield or iris 12 by means of leaf springs 30 which may, for example, consist of tungsten. It will be understood that a plurality of the leaf springs 30 are disposed about the ring 12 as shown in FIG. 1.

The manner in which the cathode 10 and its ceramic tubes 16 are mounted will now be explained. The ring 12 is supported by a plurality of brackets 31. The brackets 31 are held by screws 32 extending into a copper frame 33 which in turn supports a water cooled copper tube 39. The lower end of the copper frame 33 supports another bracket 34, which in turn is mounted on an insulator 35. Ring 12 is secured by a curved connector 36 to the bracket 31 having a corresponding curved end portion 37. The two are connected by a screw 38 covered with a ceramic sleeve which has a sliding fit in the curved bracket end portion 37, thus permitting expansion and contraction of the ring 12 and the cathode 10. It will be noted that the cathode 10 may readily be removed by removing the screws 38 on the brackets 12.

The water cooled tubes or bus bars 20 and 21 are supported by brackets 40, 41. A connector 42 provides electrical contact between the heater wire 17 and the bracket 40 and its bus bar 20. This connector may, for example, consist of tantalum or preferably nickel. In order to eliminate welding and its problems in a high heat environment, a loop may be made in the connector as shown to provide electrical contact. The heat shield 14 is supported by ceramic spacers 59 and may be flexibly held by spring 49.

Figure 2:
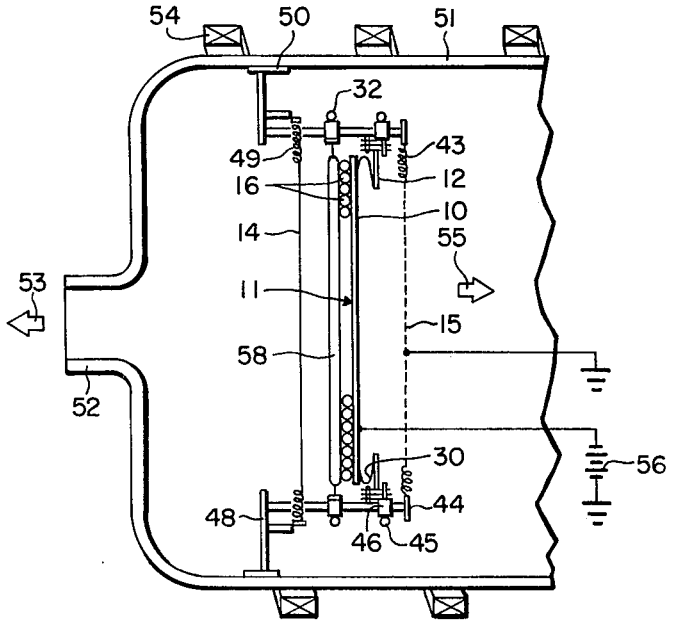
FIG. 2 is a partial cross-sectional view of a plasma container and the cathode structure of the invention corresponding to that of FIG. 1.

The anode 15 which may be grounded as shown in FIG. 2 is supported at both ends by springs 43. The springs 43 are supported in a similar manner by a bracket 44 which is secured by a screw 45 to an insulator 46 which in turn is connected to the bracket 31. Hence, anode 15 may be removed by loosening the screws 45. The anode may consist, for example, of a square tungsten mesh having a size 43×43 cm with 20 lines per inch and of 10 mil wire. The springs 43 may, for example, consist of tungsten.

The entire structure may be mounted on a support ring 48 which bears against an annular ring 50, which in turn may be wedged into a container 51 (see FIG. 2) having an opening 52 which may be evacuated as indicated by the arrow 53. A plurality of magnetic coils 54 may be provided about the container 51 to generate a magnetic field extending in the direction of arrow 55. The metallic nonmagnetic container 51 and the anode 15 may be grounded as shown while the cathode 10 may be maintained by a battery 56 at a suitable negative potential as shown. By way of example, the cathode may be maintained at a voltage of −40 to −50 volts.

To provide further support for insulating tubes 16 there may be provided a second set of insulating tubes 58 which may also consist of a suitable ceramic such as alumina. They in turn may be reinforced by inserting, say, two stainless steel rods 60 into each tube. However, it will be understood that this special set of reinforcing tubes may be omitted. In general, it should be realized that all metallic parts should preferably have a matched coefficient of expansion, be electrically conductive and capable of withstanding the high temperatures of 1200° C. or more.

The cathode may be used for producing dense discharge plasmas, for example, nobel gases, alkali metals, uranium and the like. For example, with krypton at a pressure of $3\times10^{-4}$ Torr a plasma density of $10^{12}$ particles per cubic centimeter is obtained. In this case, the emission current may be 300 amperes at a discharge voltage of 40 volts. The cathode may be used with a grided anode 15 for generating a large electron beam. The current density was 0.2 $A/cm^2$ with smaller cathodes, pulsed current densities of 1 $A/cm^2$ has been achieved.

The cathode may, for example, consist of nickel and may be coated with a mixture of barium carbonate, strontium carbonate and calcium carbonate (50% $BaCO_3$, 49.5% Sr $CO_3$, 0.5% $CaCO_3$ by weight) dissolved in an organic binder consisting of butyl alcohol, butyl acetate and nitrocellulose.

The cathode has to be activated with increasing temperature whereupon the binder components evaporate. Also the carbonates are reduced to oxides. The carbon dioxide gas which is generated during the reaction has to be pumped off and the activation process has to be carried out slowly. It should be noted that the cathode may, for example, be replaced in one day due to the simplified construction.

Figure 5:
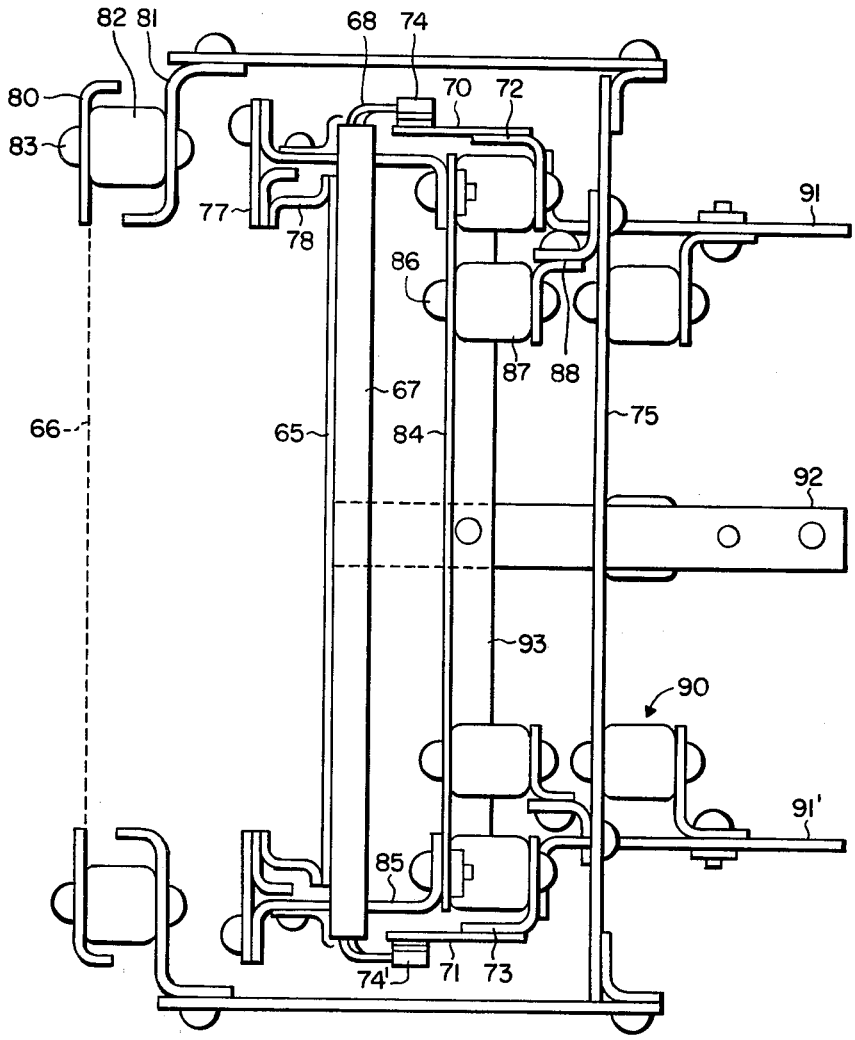
FIG. 5 is a sectional view similar to that of FIG. 2 on enlarged scale, but illustrating another embodiment of a cathode structure of the invention which is suitable for smaller size cathodes.

Reference is now made to FIG. 5 which illustrates another embodiment of the flat, indirectly heated, oxide-coated cathode of the invention which is particularly suitable for smaller cathodes. It should be noted that this embodiment of the invention does not feature any water cooling. In addition, the insulated backup tubes 58 are not used in the embodiment of FIG. 5.

The embodiment of FIG. 5 again includes a cathode 65 which is oxide-coated and a grided anode 66, both of which may be made of the same materials and in the manner described hereinabove. The cathode 65 is backed up by a plurality of insulating tubes 67 through which again extend suitable heater wires 68. Again, they are connected in such a manner that the current through the heater wires of adjacent insulating tubes 67 flows in opposite directions. The heater wires in turn are connected between a filament lead 70 and another filament lead 71. The filament leads 70 and 71 in turn are connected to copper brackets or buses 72 and 73, which are generally L-shaped as shown and between which an electrical power source is connected. The heater wires are connected to conductive elements 74 and 74' to which the heater wire may be connected by crimping. The copper buses 72 and 73 are connected in turn to a generally rectangular frame 75. The connections to the respective heater wires are preferably made in such a way that a first heater wire is say connected to the copper buses 70, 72 and subsequently the heater wire extends in a zig zag or helical fashion to the other copper bus 71, 73, to which the next portion of the heater wire is connected, and so on. In this manner, the magnetic field which is generally created upon the flow of an electric current is substantially cancelled. The heater wires may, if desired, be bifilar. A plurality of leaf springs 78 which may again consist of tungsten are disposed between cathode 65 and ring 77. It will be understood that a plurality of these leaf springs are provided about the rim of frame 77 for supporting the cathode and pressing it against the insulating tubes 67.

The grided anode 66 is again supported by an anode frame 80 which may have a substantially rectangular outline. The anode frame 80 is supported from a generally Z-shaped bracket 81 connected to the main frame 75 by an insulating member 82. By removing the screws 83 the anode may readily be removed.

A heat shield 84 may be provided behind the insulating tubes 67. It in turn is supported by generally Z-shaped brackets 85 which in turn support the annular ring 77. The heat shield 84 in turn is connected to the main frame 75 by screws 86 extending through insulating columns 87, which in turn are secured to the main frame 75 by pairs of brackets 88. A similar structure indicated at 90 connects the main frame 75 to copper leads 91 and 91' which supply the voltage for the heater wires. The cathode biasing potential is applied through a copper strap 92 extending through the frame 75 and directly connected to the cathode 65. The heat shield 84 is supported by a cross rail 93.

It will be apparent that the cathode structure of FIG. 5 is a simplified construction but otherwise operates in the same manner as does that of FIGS. 1 through 4.

There has thus been disclosed a cathode structure including an oxide-coated cathode which is indirectly heated. The structure is such that it will support a large size cathode and will maintain the cathode flat in spite of the high temperatures to which it is exposed. The connections to the heater wires which indirectly heat the cathode are such that the current through the heater wires of adjacent insulated tubes flows in opposite directions, thereby to substantially minimize the creation of a magnetic field. In addition, the insulating tubes which support the heater wires in turn support the cathode against a plurality of springs which in turn bear against a ring. This ring in part serves as a heat shield which minimizes any temperature gradient which may be caused around the periphery of the cathode. The cathode and anode jointly can produce a very large, dense and quiescent plasma which may be used for various purposes. For example, a large size electron or ion beam may be created. In this case the grided anode may be omitted but an accelerating field for the electron or ion must be provided, such as a background plasma.

What is claimed is:

1. A large, indirectly heated, oxide-coated cathode structure comprising:

(a) a substantially flat cathode of substantial size having one oxide-coated surface;

(b) a first plurality of insulating tubes disposed parallel to each other and in contact with the uncoated surface of said cathode;

(c) at least one heater wire extending through each of said insulating tubes for heating at will said cathode to a predetermined temperature;

(d) a second plurality of insulating tubes secured in substantially fixed position and disposed substantially at right angles to said first plurality and in contact therewith;

(e) means for pressing the periphery of said cathode against said first plurality of tubes thereby to maintain said cathode substantially flat in spite of thermal expansion thereof; and (f) an annular ring spaced from and surrounding the periphery of said cathode, said ring serving as a support for said last-mentioned means.

2. A cathode structure as defined in claim 1 wherein a grided anode is disposed spaced from said flat cathode.

3. A cathode structure as defined in claim 2 wherein means is provided for separately supporting said cathode and said anode, whereby each may be removed separately.

4. A cathode structure as defined in claim 3 wherein said means for separately supporting said cathode and said anode includes metallic tubes for carrying cooling fluid.

5. A cathode structure as defined in claim 1 wherein an electric current source is provided connected to said heater wires and means for passing current through said heater wires in alternate insulating tubes in opposite directions to minimize the magnetic field created by the electric current.

6. A cathode structure as defined in claim 5 wherein two hollow metallic tubes are provided for carrying cooling fluid, each of said tubes being connected to one pole of said current source and each of said heater wires being connected between said two tubes to supply the flow of current therethrough, adjacent ends of alternate wires being connected to alternate ones of said tubes whereby the direction of current flow through said wires is reversed in alternate wires.

7. A cathode structure as defined in claim 6 wherein each of the heater wires is connected in turn to a nickel connector for connecting each wire to its associated metallic tube.

8. A cathode structure as defined in claim 1 wherein said cathode is of substantially circular outline.

9. A cathode structure as defined in claim 1 wherein said further plurality of insulating tubes is provided each with at least one reinforcing metallic tube.

10. A cathode structure as defined in claim 1 wherein said spring means for pressing said cathode against said insulating tubes consist of a plurality of tungsten strips.

11. A large, indirectly heated, oxide-coated cathode structure, said structure comprising:

(a) a substantially flat oxide-coated, electron-emitting cathode;
(b) a plurality of brackets spaced about the periphery of said cathode;
(c) a plurality of insulating tubes extending parallel to each other adjacent the uncoated surface of said cathode;
(d) spring means disposed between said brackets and the periphery of said cathode for resiliently pressing said cathode against said insulating tubes;
(e) heater wires extending through said insulating tubes;
(f) means including a current source for causing current to flow through said heater wires in such a manner that the current through the heater wires of adjacent insulating tubes flows in opposite directions, thereby to minimize the resulting magnetic field;
(g) a heat shield disposed adjacent said insulating tubes oppositely from said cathode;
(h) an anode structure consisting of a wire mesh facing the electron-emitting surface of said cathode;
(i) separate means for supporting said anode, and
(j) support means for maintaining said insulating tubes in substantially fixed positions.

12. A cathode structure as defined in claim 11 which cathode is of substantially circular outline.

* * * * *